US010425991B2

(12) United States Patent
Burgener, II et al.

(10) Patent No.: US 10,425,991 B2
(45) Date of Patent: Sep. 24, 2019

(54) PULSE ENERGY GENERATOR SYSTEM

(71) Applicant: KEN GEN ENERGY, LLC, Murray, UT (US)

(72) Inventors: Robert H. Burgener, II, Park City, UT (US); Troy Atkin, Mounds, OK (US)

(73) Assignee: KEN GEN ENERGY, LLC, Murray, UT (US)

( * ) Notice: Subject to any disclaimer, the term of this patent is extended or adjusted under 35 U.S.C. 154(b) by 215 days.

(21) Appl. No.: 15/676,681

(22) Filed: Aug. 14, 2017

(65) Prior Publication Data

US 2018/0044812 A1 Feb. 15, 2018

Related U.S. Application Data

(60) Provisional application No. 62/374,386, filed on Aug. 12, 2016.

(51) Int. Cl.

| | |
|---|---|
| ***C25D 17/12*** | (2006.01) |
| ***F24H 1/10*** | (2006.01) |
| ***C25D 3/12*** | (2006.01) |
| ***C25D 3/48*** | (2006.01) |
| ***C25D 3/50*** | (2006.01) |
| ***H05B 3/02*** | (2006.01) |
| ***H05B 3/03*** | (2006.01) |
| ***C25D 17/00*** | (2006.01) |
| ***C25D 5/18*** | (2006.01) |
| ***C25D 17/10*** | (2006.01) |
| ***H05B 3/00*** | (2006.01) |

(52) U.S. Cl.

CPC ..... *H05B 3/03* (2013.01); *C25D 3/12* (2013.01); *C25D 3/48* (2013.01); *C25D 3/50* (2013.01); *C25D 5/18* (2013.01); *C25D 17/00* (2013.01); *C25D 17/008* (2013.01); *C25D 17/10* (2013.01); *C25D 17/12* (2013.01); *F24H 1/106* (2013.01); *H05B 3/0004* (2013.01); *H05B 3/023* (2013.01)

(58) Field of Classification Search

CPC .. C25D 5/18; H05B 3/03; H05B 3/023; F24H 1/106

See application file for complete search history.

(56) References Cited

U.S. PATENT DOCUMENTS 6,365,881 B1 * 4/2002 Itzhak ..... A47J 27/21025 219/481
8,565,588 B2 * 10/2013 Bierbaumer ..... F24H 3/004 392/311

(Continued)

*Primary Examiner* — Nicholas A Smith
(74) *Attorney, Agent, or Firm* — Kirton McConkie; Evan R. Witt

(57) ABSTRACT

Apparatus and methods for generating thermal energy from a pulsed DC electric power source utilizing pairs of electrodes disposed in a water medium. Electric pulses are provided at a frequency up to 20 MHz. Efficiencies are obtained when multiple pairs of electrodes are powered by the pulsed DC electric power source. The electrodes may be rods, plates, cylinders, or other useful shapes. The electrodes exposed to water may be a metal or alloy of nickel, platinum, palladium, or tungsten. The DC pulse generator is electrically connected to the electrodes to provide a source of pulsed direct current electric power. The input polarity to the electrodes may be periodically reversed or alternated between the anode and cathode polarity to limit erosion/electroplating of electrode material.

18 Claims, 4 Drawing Sheets

(56) References Cited

U.S. PATENT DOCUMENTS

| | | | | |
|---|---|---|---|---|
| 10,077,907 | B2 * | 9/2018 | De Vries | C02F 1/4602 |
| 2012/0308212 | A1 * | 12/2012 | Bierbaumer | F24H 1/106<br>392/315 |
| 2012/0312886 | A1 * | 12/2012 | Artmayr | F24H 1/106<br>237/59 |

* cited by examiner

PULSE ENERGY GENERATOR SYSTEM

CROSS-REFERENCE TO RELATED APPLICATION

This application claims the benefit of U.S. Provisional Application No. 62/374,386, filed Aug. 12, 2016, and entitled PULSE ENERGY GENERATION SYSTEM. This prior application is incorporated by reference.

FIELD OF THE INVENTION

This disclosure relates to the generation of thermal energy from a pulsed DC electric power source. More specifically, the disclosure relates to a reactor configuration that generates energy from a pulsed electric power source when applied through electrodes to a water medium.

BRIEF SUMMARY OF THE INVENTION

The disclosed invention relates to an apparatus and method for generating energy in a water medium utilizing a pulsed electric power source. The disclosed apparatus may be in the form of a reactor for heating water. The disclosed reactor includes at least one pair of spaced metal electrode elements. In some non-limiting aspects of the invention, the electrodes are fabricated of a metal or alloy comprising nickel, platinum, palladium, or tungsten. Nickel is a presently preferred electrode material because of its relatively low cost and ability to electroplate. Tungsten has been observed to dissolve in solution over time and is less preferred. The electrodes used in the reactor can be configured as rods, flat plates, cylindrical tubes, or any other geometric configuration that allows them to function as intended. At least a portion of the electrode surface is disposed in and exposed to water.

In one disclosed embodiment, a plurality of pairs of electrodes pairs can be connected in a serial configuration to a single pulsed electric power source.

In one non-limiting embodiment, the pulsed electric power source is a DC pulse generator. The DC pulse generator is electrically connected to each pair of electrodes, one electrode having an anode electrical polarity and the other electrode having a cathode electrical polarity. The DC pulse generator provides a source of pulsed DC electric power to the pair of electrodes. The electrodes are disposed within a suitable housing.

In one non-limiting embodiment, the pulsed DC electric power level is between 1 and 1500 watts input, depending on power service available. In another non-limiting embodiment, the power level is between 10 and 1000 watts input.

In one non-limiting embodiment, the pulse frequency is between 10 Hz and 20 MHz, continuous input.

It is presently preferred to control the amount of electrode surface exposed to the water. One non-limiting method of doing so is to provide an insulating coating on the electrode surface such that only a portion of the electrode without the insulating coating is exposed to water. Any suitable insulating material may be used that provides good thermal and electrical insulation. Non-limiting examples of insulating materials include ceramic insulating materials such as beryllium oxides, alumina, silica, etc. Ceramic insulating materials may also be used to insulate the electrode body and structures used to mount the electrode within a reactor apparatus. Silicon heat wrap insulation may also be successfully used.

In some non-limiting embodiments, the amount of electrode surface exposed to the water may range from about 1 mm to about 40 mm.

It has been observed that the amount of power input to the electrodes may vary depending upon the amount of electrode surface exposed to the water. If more electrode surface is exposed to the water, more power can be input to the electrode. By way of non-limiting example, electrodes having about 10 mm of water exposure may be able to receive 300 watts input. Electrodes having about 40 mm of water exposure may be able to received 600 watts input. Higher power input of 1000 to 1500 watts will require even more electrode surface exposed to water.

Without being bound by theory, it is presently believed that the pulse sends out a heated compression wave, due to resistance of the water, and a compression wave to surface tension of the surface of the water, forcing the water into the critical point in the phase diagram of water. This produces dissociation of water molecules into hydrogen and oxygen, but it is believed that some dissociation of water in the form of hydrides and hydrogen ions that already exist normally in water at equilibrium can be forced into water molecules due to vapor at the critical point, thus producing high excess heat.

The electrodes may be separated by a distance in the range from about 0.5 mm to about 30 mm. Non-conductive spacers, such as ceramic washers, may be used to maintain electrode spacing and prevent them from touching each other.

Another aspect of the invention relates to the apparatus and methods of heating water from a pulsed DC power source. Such apparatus may have multiple plates in parallel in contact with the top of the water surface.

Non-conductive spacers, such as ceramic washers, may be used to prevent the parallel plate electrodes from touching each other or from touching the inside surface of the reactor.

The DC pulsed power source provides pulses to each pair of electrodes at a controlled frequency. In one non-limiting embodiment, the frequency may be as high 20 MHz. In other embodiments, the frequency may be as high as 1000 Hz. In one non-limiting embodiment, the pulse frequency may be between 15 Hz and up to 20 MHz. In another non-limiting embodiment, the pulse frequency is between 20 and 60 Hz. In another non-limiting embodiment, the pulse frequency is between 30 and 50 Hz. In yet another non-limiting embodiment, the pulse frequency is between 35 and 45 Hz. In another non-limiting embodiment, between 37 Hz and 40 Hz. In one non-limiting embodiment the pulse frequency is about 38 Hz.

It has been observed that during operation of the wet reactor apparatus, the metal forming the electrodes is oxidized and reduced. This is sometimes referred to as electrode erosion or dissolution. Thus, if a nickel electrode is used, nickel is oxidized at the cathode, releasing nickel ions in the water. In contrast, at the anode nickel ions are reduced and plated onto the electrode. One way to balance the oxidation and reduction of the metal electrodes is to periodically reverse the anode and cathode polarity of the wet reactor apparatus. The electrode polarity may be reversed using a relay or another electronic method. Periodically reversing the anode and cathode polarity of the DC pulse generator during operation can balance out any electrode metal erosion and electroplating so that a substantially equal or constant amount of material remains on the electrodes at all times. The period of time between each polarity reversal may vary depending upon power levels and so forth, but in one non-limiting embodiment, the time period is between about 1 and 20 minutes.

The pulse energy generator system may include a heat exchanger to withdraw heat generated by the system. The heat exchanger is preferably a closed loop system having a working heat exchange fluid isolated from the water that is heated in the reactor. That way the chemical composition of the water within the reactor may be controlled and maintained.

Another aspect of the pulse energy generator design is the power supply. The power supply preferably delivers sharp pulses at adjustable duty cycles. In one non-limiting embodiment, the duty cycle may range from about 1 to about 10%, and more preferably, from about 2% to about 7%. A square pulse edge can be desirable to initiate the water hammering effect or compression wave to induce the critical point of water. In one non-limiting embodiment, a frequency of 130 KHz can be used with a parallel plate configuration to also initiate water hammering effect and compression wave on the electrodes. In this case, the power supply provided a minimum of 163 volts and 0.6 amps. The power supply may operate at higher voltage, up to about 10,000 volts, at very low current. In one non-limiting embodiment, the power supply operates at a voltage up to about 1000 volts at minimal current. In another non-limiting embodiment, the power supply operates at a voltage up to about 600 volts.

Another aspect of the power supply is the ability for a microprocessor to operate and drive multiple wet cell reactors simultaneously. For example, one to twenty reactors could be connected to, and be operated by, one power supply and one power source. The power supply can be adjusted up to as much power that can be delivered to one unit at one time, and at a frequency to run all reactor units sequentially.

In one non-limiting example, a water soluble salt may be added to the water to improve electrical conduction or reduce resistance of the water. Potassium carbonate at a concentration up to about 0.2 molar has been used to improve electrical conduction or reduce resistance of the water. Other common soluble salts known to persons having ordinary skill in the art can also be used.

One aspect of the power supply can supply pulsed DC power at 36 KHz to multiple wet reactors. Another aspect of the DC power supply is that it can be pulsed at 131 KHz, or higher, to multiple wet reactors.

The power supply may be modified with a capacitor from 1 to 100 microfarads, depending on the exposed electrode surface area being used. In one non-limiting embodiment, a 75 microfarad capacitor can be used. The capacitor helps to filter out noise in the DC pulse power generator and electrodes. A ferrite core inductor of about 6 to 7 microhenry may be used to eliminate the noise generated from the reaction in the water.

In a non-limiting embodiment, an electronic switch can be used to drive and sequence the DC pulse to multiple output channels. Numerous possible switch devices can be used, including but not limited to bipolar transistors (IGBT), field-effect transistors (FET), TRIAC, or other switching device. Such device may be connected to either the positive electrode, negative electrode, or both electrodes to turn them on and off quickly and sequentially as desired.

The reactors can be linked in series, which may multiply the net energy output. For example, if one reactor produces 3 times the input energy, then 2 reactors may produce up to 6 times the input energy, and so on. The gain or multiplier effect of multiple reactors in series is rarely 100%, so if one reactor produces 2 times the input energy, then 2 reactors in series may produce up to 4 times the input energy.

BRIEF DESCRIPTION OF THE SEVERAL VIEWS OF THE DRAWINGS

In order that the manner in which the above-recited, and other features and advantages of the invention are obtained will be readily understood, a more particular description of the invention briefly described above will be rendered by reference to specific embodiments thereof that are illustrated in the appended drawings. Understanding that these drawings depict only typical embodiments of the invention, and are not, therefore, to be considered to be limiting of its scope, the invention will be described and explained with additional specificity and detail through the use of the accompanying drawings in which.

DETAILED DESCRIPTION OF THE INVENTION

The disclosed invention relates to apparatus and methods for generating energy from a pulsed electric power source. Various aspects and embodiments of the disclosed invention will be described in relation to the Figures.

Figure 1:
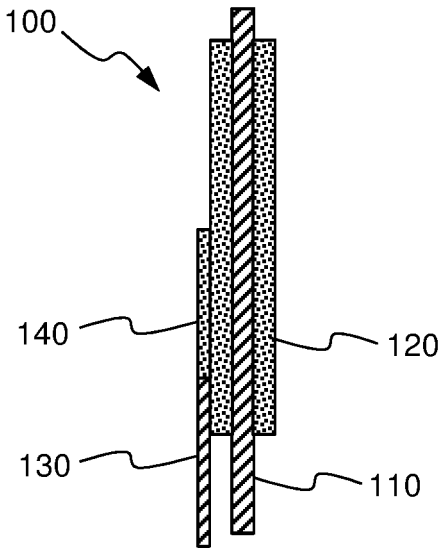
FIG. 1 discloses an electrode structure that may be used in connection with an apparatus for generating energy from pulsed electric power utilizing a reactor.

FIG. 1 discloses an electrode structure 100 that may be used in connection with an apparatus for generating energy from pulsed electric power utilizing a reactor. The electrode structure includes an electrically conductive electrode 110. The electrode 110 can have various geometric shapes. For instance, the electrode 110 may be configured as a rod. The specific dimensions and configuration may vary. The electrode rod may have a diameter from 0.15 mm to 6.5 mm. Smaller diameters are preferred for low power applications. The electrode rod may have a length that is exposed to water from about 10 to 50 mm. In some non-limiting embodiments, the length of electrode exposed to water may range from 20 to 30 mm. The electrode may be made of various metals used in electrodes exposed to water, such as those described above. Nickel is a presently preferred electrode metal. The electrode 110 may be configured as flat plate. The electrode 110 may be configured as tube.

The electrode 110 includes a non-conductive or insulating covering 120. The covering 120 may be in the form of a coating or insulating wrap. In one non-limiting embodiment, the insulating covering 120 may be made of ceramic.

In some non-limiting embodiments, the electrode 110 may include an optional electron shield 130. The electron shield 130 has no electrical connection to the electrode 110. The electron shield 130 is made of a conductive material such as metal. The electron shield has a size and shaped configured to shield the electrode 110 from an adjacent electrode. Based upon the size of the electrode 110 mentioned above, the electron shield 130 would have a size of about 25 mm in length and 10 mm width. An electron shield connector 140 may be provided to connect the electron shield to the electrode structure.

Figure 2:
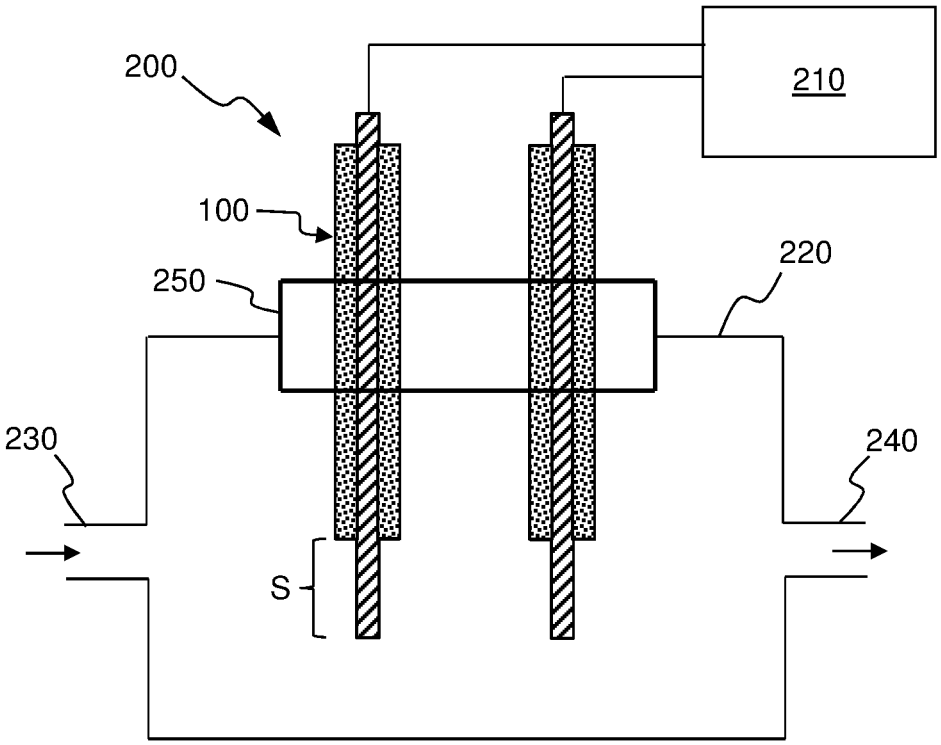
FIG. 2 discloses a wet reactor apparatus for generating energy from a pulsed DC electric power source.

FIG. 2 discloses a wet reactor apparatus 200 for generating energy from a pulsed DC electric power source 210. The apparatus 200 includes a reactor housing 220. The housing may be made of a conductive or non-conducive material. Non-limiting examples of conducive material includes a metal compatible with water. Non-limiting examples of non-conductive include ceramic. The reactor housing 220 preferably includes water inlet and outlet ports 230, 240, respectively.

The apparatus 200 includes at least one pair of electrodes 110 having electrode structures 100 as described above. Each electrode 110 is electrically connected to the pulsed DC electric power source 210. Each electrode 110 will have either a cathode or anode polarity during operation. As described herein, the pulsed DC electric power source 210 may periodically reverse the electrode polarity during operation. The electrode structures may be mounted to the housing 220 using an electrode port fixture 250. The electrode port fixture 250 is a mechanical mount for the electrode structure 100 that screws into or otherwise makes a hermetic seal with the reactor housing 220. Preferably only a portion of the electrodes 100 have is exposed to the water within the reactor apparatus 200. The surface of the electrode exposed to water is shown by the letter "S".

Figure 3:
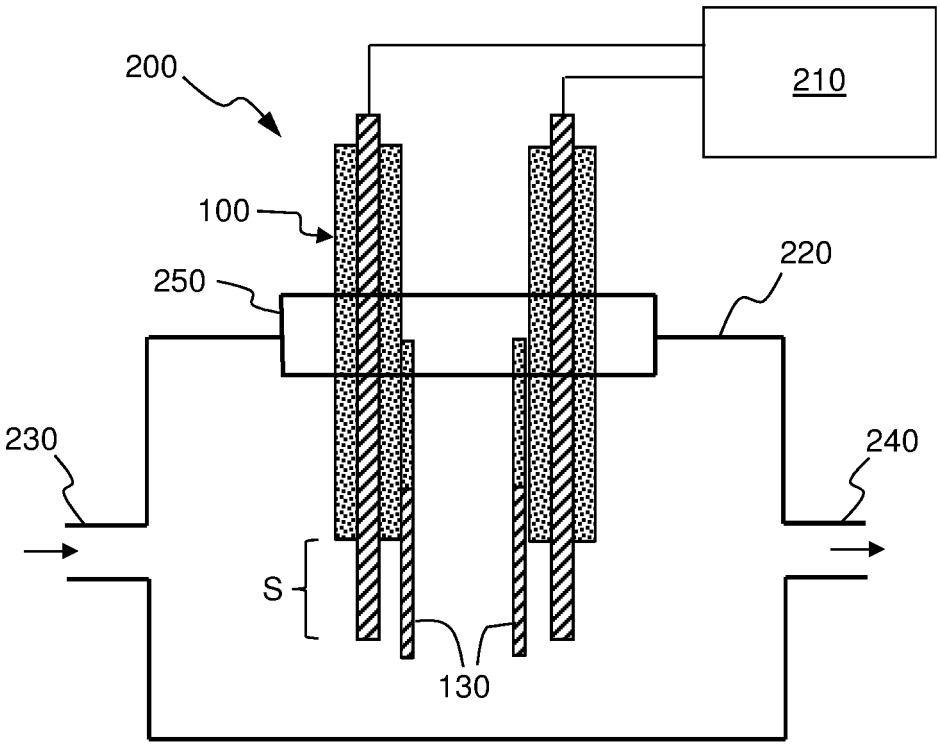
FIG. 3 discloses another wet reactor apparatus for generating energy from a pulsed DC electric power source utilizing electron shields.

FIG. 3 discloses a wet reactor apparatus 200 for generating energy from a pulsed DC electric power source as shown in FIG. 2, except that electron shields 130 are provided.

Figure 4:
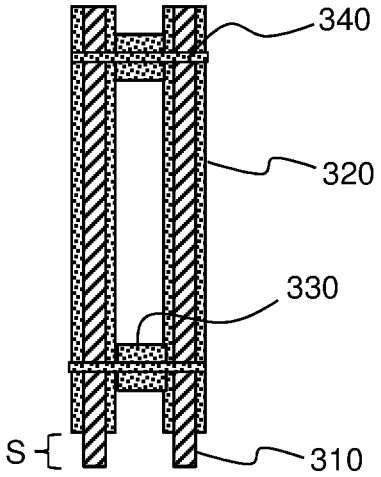
FIG. 4 discloses a side, cross-sectional view of a pair of parallel plate electrodes for use in an apparatus for generating energy from pulsed electric power.

FIG. 4 discloses a side, cross-sectional view of a pair of parallel plate electrodes 310 for use in an apparatus for generating energy from pulsed DC electric power. The plate electrodes 310 have an electrode structure is as described above with a non-conductive, insulating cover 320. The cover may be made of ceramic. The non-conductive cover does not cover edges of the plate electrode 310. The plate electrodes 310 are separated by non-conductive spacers 330 to provide plate spacing. The spacers 330 may be made of a non-conductive material. The spacers 330 may have a thickness from about 0.35 mm to 1.3 mm. In one non-limiting embodiment, the spacers 330 have a thickness from 0.5 mm to 0.8 mm, with a thickness of approximately 0.65 mm being presently preferred. Fasteners 340 may be used to assemble the parallel plate electrodes. The fasteners 340 are preferably made of a nonconductive material such as a ceramic, nylon, or other nonconductive material.

Figure 5:
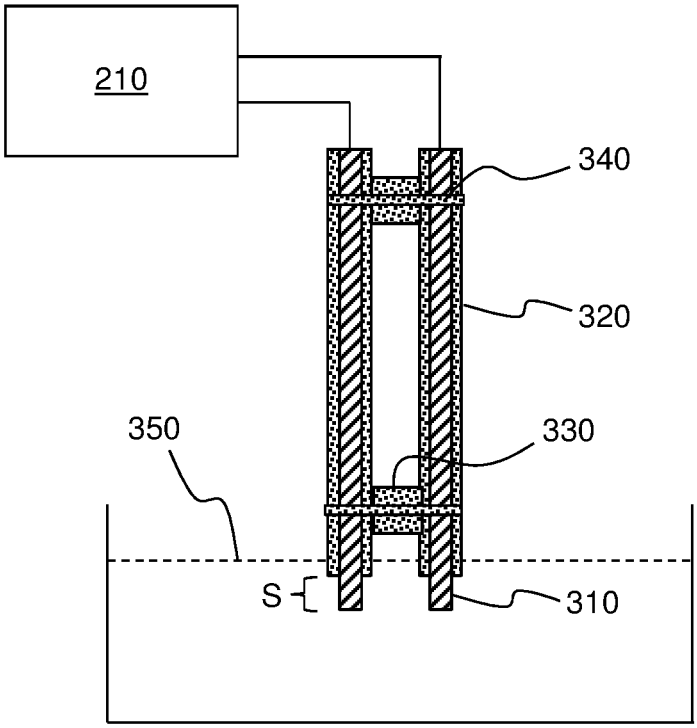
FIG. 5 discloses an apparatus for generating energy from pulsed electric power utilizing a plate reactor disposed in water.

FIG. 5 discloses an apparatus for generating energy from pulsed electric power utilizing parallel plate electrodes disposed in water. The electrodes 310 are electrically connected to a pulsed DC electric power source 210. A portion of the surface S of the electrodes is exposed to water that is heated. The electrodes are disposed just below the water surface 350. In one non-limiting embodiment, the electrodes are disposed in the top 1.5 mm of water.

The water is contained within a reactor housing 360, which may have a configuration as disclosed herein. The housing may be made of a conductive or non-conducive material. Non-limiting examples of conducive material includes a metal compatible with water. Non-limiting examples of non-conductive include ceramic. The reactor housing 350 preferably includes water inlet and outlet ports to facilitate continuous water heating.

It will be understood that disclosed wet reactor apparatus for generating energy from a pulsed DC electric power source may include multiple pairs of electrodes within a single reactor housing. Alternatively, multiple reactors may be configured in series or in parallel depending on the water heating needs. For instance, if high volume water heating is desired, then multiple reactors in parallel may be preferred. Alternatively, if a higher temperature increase is desired, then configuring multiple reactors in series may be preferred. In some cases, combinations of parallel and series reactors may be desired and within the scope of the disclosed invention.

Figure 6:
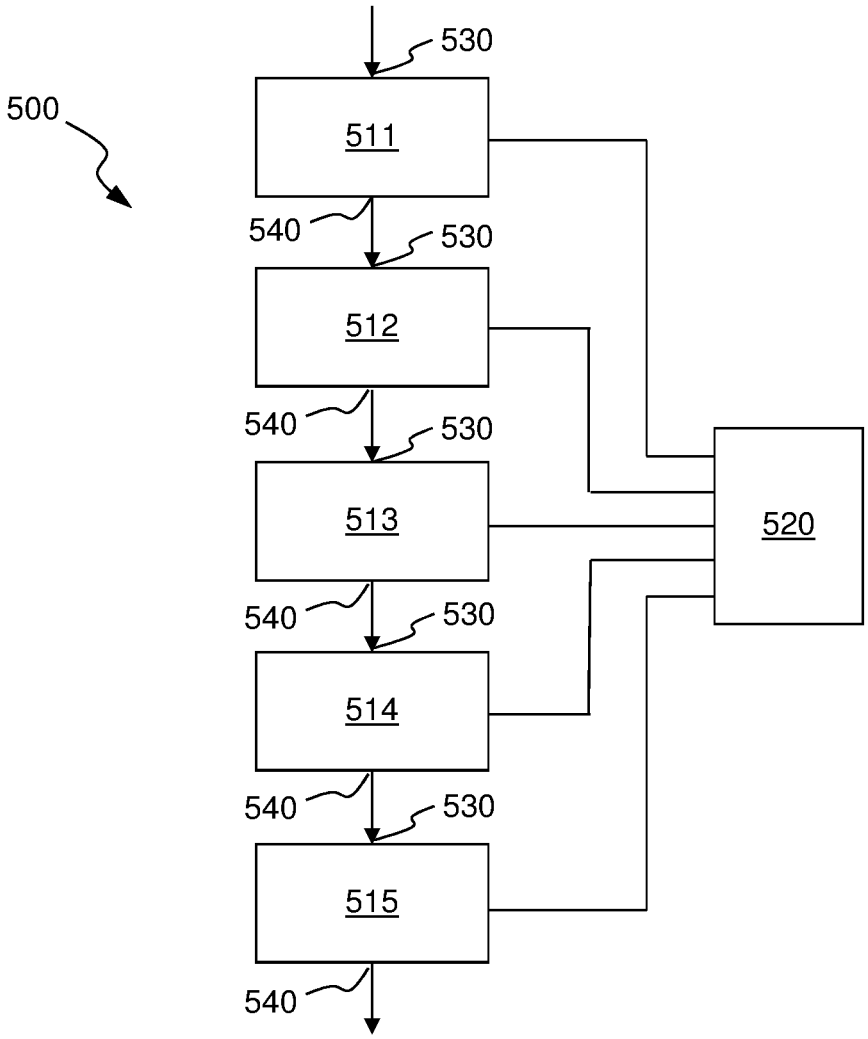
FIG. 6 discloses an apparatus for generating energy from multiple reactors and a pulse DC electric power sequencer control system.

FIG. 6 discloses an apparatus 500 for generating energy from multiple reactors 511, 512, 513, 514, and 515 and a pulse DC electric power sequencer control system 520. Each of the reactors includes one or more pairs of electrodes. The pairs of electrodes are electrically connected to the pulse DC electric power sequencer control system 520. The electrodes may include plate electrodes or rod electrodes.

The pulse DC electric power supply sequencer control system 520 provides energy pulses to each reactor unit sequentially, one at a time, at the same power input level, regardless if using one reactor or all five reactors. The pulse DC electric power supply sequencer control system includes an electronic switch to drive and sequence the DC pulse to multiple output channels. In one non-limiting embodiment, the reactors receive energy pulses at a frequency of about 1000 Hz and a pulse length of about 10 to 30 microseconds. A longer pulse length will provide more power to the reactor electrodes. Higher frequency pulsing may enable pulsed DC power to be provided to large numbers, even 100 or more reactors.

The reactors 511, 512, 513, 514, and 515 shown in FIG. 6 are connected in series in which the water inlet 530 is connected to the water output 540 from an adjacent upstream reactor. Reactors connected in series multiply the energy output.

Producing a DC pulse on electrode materials disposed in water can liberate a compression wave that can produce pressure against the electrode. The resistance of water can also produce heat. Heat and pressure in combination can cause water to enter its critical point where all three phases can coexist. Without being bound by theory, the wet reactor DC pulse energy generator systems disclosed herein, involve the conversion of liquid water to vapor at the critical point and back again to liberate heat.

One aspect of the invention to extend the electrode lifetime is to periodically reverse the anode and cathode polarity. This may stop and reverse the dissolution and electroplating of the electrode material. Another aspect of the invention to extend the electrode lifetime is to saturate the water with electrode material ions.

One aspect to the invention is the use of a metal electron shield for electrodes disposed in the water reactor. The shield helps to uniformly distribute the electric field on to the exposed part of the electrode, thereby reducing voltage and power levels. Another aspect of the shield is to diffuse the electric field in the aqueous solution so the exposed electrode can react more homogenously and allow uniform current density throughout the electrode area. The electrodes can function without a shield. But improved performance has been observed when an electrode shield is used. Specifically, it has been observed that the wet reactor can operate at a lower current, even a third less current, and provide the same performance as a reactor without electrode shields. The electron shields can have any size, shape or configuration to shield the electrode.

In one embodiment of the disclosed invention, the electrodes are configured as parallel metal plates. In one non-limiting embodiment, the plates are made of nickel. In one non-limiting embodiment, the plates are mounted as close to each other as possible, preferably, within 0.5 millimeters. The plates may be of any suitable size and shape. In one non-limiting embodiment, each plate can be 10 centimeters high and 5 centimeters wide. Only the bottom edge of each plate can be exposed to the water, while the rest of the metal plates can be coated with electrical insulating material. Having only the bottom edge of each plate uninsulated and exposed to water can create a very high electric field between the plates.

In one non-limiting embodiment of the wet reactor utilizing pairs of electrodes, the water may include an aqueous salt solution to improve water conductivity. Potassium carbonate is one presently preferred salt solution. A concentration up to 0.2 molar potassium carbonate may be used.

A salt solution containing ions of the metal from which the electrodes are fabricated may also be desirable to inhibit metal stripping from the electrode. For example, if the electrodes are fabricated of nickel, then including nickel ions in the water may be beneficial.

Improved performance has been observed by eliminating plasma formation on the electrode by either decreasing the operating current or increasing the length of the electrode exposed to the aqueous solution.

The following examples and experimental results are given to illustrate various embodiments within the scope of the present disclosure. These are given by way of example only, and it is understood that the following examples are not comprehensive or exhaustive of the many types of embodiments of the present disclosure that can be prepared in accordance with the present disclosure.

In the examples, power input was measured using an oscilloscope and power meters, along with volt meters. It was found that using a 0.01 ohm shunt resistor in line as the input side of the power supply works well, along with power meters. The power supply can be a regulated switch mode power supply, a linear power supply, or batteries, modified with a capacitor and switching transistor, such as FET, IGBT, or Triac, or other switching device.

In the examples, the measured heat energy out into water was determined by measuring temperature change and time. Typically, the experiments operated for approximately 180 seconds, which, when multiplied by 4.18 joules per degree C. per gram of water, can yield an average energy output. The electrode material was also taken into account, and water was insulated to reduce heat loss. This does not take into consideration the energy to dissociate water molecule into hydrogen and oxygen. I microprocessor controlled the pulse rate. The pulse rates ranged from 38 Hz to 131,000 Hz.

Example 1

A pulse energy generator system was prepared that contained a pair of tungsten rod electrodes at 1 mm diameter and spaced 25 mm apart. The electrodes each had an electron field distributor (shield) placed 5 mm from the electrode. The shields were approximately 5 mm square. The tungsten electrodes were connected to a DC pulse generator. The electrodes were placed into 180 grams of 0.2 mole potassium carbonate in water at 32.1° C. The DC pulse generator operated at 60 Hz, with a run time of 180 seconds. The average input power was 10 watt in. The ending water temperature was 39.8° C. Based upon the increase in water temperature, the measured output power was [(7.7° C.)(4.182 J/g·° C.)(180 g)]/(180 sec)=32.2 watts or a 3.2 times output.

Example 2

The pulse energy generator system of Example 1 was operated. The electrodes were placed into 140 grams of water at 46° C. The DC pulse generator operated at 38 Hz, 2500 microseconds on and 24000 microseconds off with a run time of 180 seconds. The average input power was 19 watts. The ending water temperature was 81° C. Based upon the increase in water temperature, the measured output power was 113.8 watts based upon the calculation [(35° C.)(4.182 J/g·° C.)(140 g)]/(180 sec).

Example 3

A pulse energy generator system similar to Example 1 was prepared with nickel electrodes placed into 145 grams of water with 0.2 molar of potassium carbonate with an initial temperature at 43.1 C. The electrodes were powered by a DC pulse of 26 KHz at 6.4 microseconds pulse width, and an input power of 60 watts. 120 seconds later the ending water temperature was 65.5 C and about 1 gram of water loss showed a heated output of 128 watts out.

Example 4

The pulse energy generator system of Example 3 was operated. The nickel electrodes were place in 140 grams of water containing 0.2 molar of potassium carbonate with an initial temperature of about 40 C. The electrodes were powered by a DC pulse of 50 KHz frequency and pulse width of 11.4 microseconds and input power of 70 watts. The ending temperature was 51.4 C. and 1 gram of water loss was measured. The heated output power was 140 watts out.

While specific embodiments and examples of the present invention have been illustrated and described, numerous modifications come to mind without significantly departing from the spirit of the invention, and the scope of protection is only limited by the scope of the accompanying claims.

The invention claimed is:

1. A pulse energy generator system comprising:

a wet reactor heater comprising at least one pair of electrodes in contact with water wherein the electrodes comprise an electrode metal that is oxidized and reduced to cause electrode metal oxidation and dissolution and electrode metal electroplating at the electrodes, wherein the electrode metal is selected from nickel, platinum, palladium, and gold; and a DC pulse generator, connected to the electrodes to provide a source of pulsed DC electric power to the electrodes, wherein the pulsed DC electric power level is in the range from 1 to 1500 average watts, wherein the pulse frequency is between 15 Hz and 20 MHz, and wherein the electrodes connected to the DC pulse generator have a first anode and cathode polarity.

2. The pulse energy generator system according to claim 1, further comprising a plurality of pairs of electrodes.

3. The pulse energy generator system according to claim 1, wherein the electrodes are configured rods, cylinders, or plates.

4. The pulse energy generator system according to claim 1, wherein the electrodes are configured as rods having a diameter in the range from 0.15 mm to 6.5 mm.

5. The pulse energy generator system according to claim 1, wherein the electrodes are separated by a distance in the range from about 0.2 mm to about 25 millimeters in the water.

6. The pulse energy generator system according to claim 1, wherein the electrodes have an uninsulated surface exposed to water and wherein from 5 to 20 mm of the uninsulated surface is exposed to water.

7. The pulse energy generator system according to claim 1, further comprising an insulated metal electron shield.

8. The pulse energy generator system according to claim 1, further comprising a switch to reverse the first anode and cathode polarity and cause the electrodes connected to the DC pulse generator to have a second anode and cathode polarity.

9. The pulse energy generator system according to claim 1, wherein the water comprises a solution of electrode metal ions.

10. The pulse energy generator system according to claim 1, wherein the water comprises a saturated solution of electrode metal ions.

11. The pulse energy generator system according to claim 2, wherein the DC pulse generator delivers energy pulses to the plurality of pairs of electrodes sequentially, one pulse at a time, while maintaining an input power, and wherein the DC pulse generator periodically reverses the first anode and cathode polarity of the plurality of pairs of electrodes connected thereto.

12. The pulse energy generator system according to claim 11, wherein the DC pulse generator delivers energy pulses to the plurality of electrode pairs sequentially at a pulse frequency to each pair of electrodes between 30 Hz and 250 KHz.

13. The pulse energy generator system according to claim 11, wherein the DC pulse generator delivers energy pulses to the plurality of electrode pairs sequentially at a pulse frequency to each pair of electrodes between 30 Hz and 20 MHz.

14. The energy generator system according to claim 1, wherein the DC generator provides a pulse frequency less than 25 KHz.

15. The pulse energy generator system according to claim 1, wherein the water comprises potassium carbonate at a concentration up to 0.2 molar.

16. The pulse energy generator system according to claim 1, wherein the DC pulse generator provides a voltage between 125 volts and 10,000 volts.

17. The pulse energy generator system according to claim 1, wherein the DC pulse generator provides a voltage between 125 volts and 1000 volts.

18. The pulse energy generator system according to claim 1, wherein the DC pulse generator provides a pulsed current, voltage, and pulse length having an electric power level between 10 and 1500 watts per pair of electrodes.

* * * * *